US010458192B2

(12) United States Patent
Zanichelli

(10) Patent No.: US 10,458,192 B2
(45) Date of Patent: Oct. 29, 2019

(54) DRILLING MACHINE

(71) Applicant: SOILMEC S.p.A., Cesena (FC) (IT)

(72) Inventor: Alessio Zanichelli, Cesena (IT)

(73) Assignee: SOILMEC S.P.A., Cesena (FC) (IT)

( * ) Notice: Subject to any disclaimer, the term of this patent is extended or adjusted under 35 U.S.C. 154(b) by 0 days.

(21) Appl. No.: 15/696,362

(22) Filed: Sep. 6, 2017

(65) Prior Publication Data

US 2018/0066483 A1 Mar. 8, 2018

(30) Foreign Application Priority Data

Sep. 7, 2016 (IT) ..... 102016000090502

(51) Int. Cl.

| | |
|---|---|
| ***E21B 7/02*** | (2006.01) |
| ***E21B 19/00*** | (2006.01) |
| ***B66D 1/46*** | (2006.01) |
| ***B66D 1/50*** | (2006.01) |
| ***B66D 1/60*** | (2006.01) |
| ***E21B 44/02*** | (2006.01) |

(52) U.S. Cl.

CPC ..... *E21B 19/008* (2013.01); *B66D 1/46* (2013.01); *B66D 1/505* (2013.01); *B66D 1/60* (2013.01); *E21B 7/02* (2013.01); *E21B 44/02* (2013.01)

(58) Field of Classification Search

CPC ..... E21B 7/02; E21B 19/008

See application file for complete search history.

(56) References Cited

U.S. PATENT DOCUMENTS 5,630,477 A 5/1997 Minatre

FOREIGN PATENT DOCUMENTS

| | | |
|---|---|---|
| EP | 1247778 A2 | 10/2002 |
| JP | S59160683 U | 10/1984 |

OTHER PUBLICATIONS

Italian Search Report for corresponding Italian Application No. IT201600090502 (2 Pages) (dated Jul. 7, 2017).

*Primary Examiner* — Giovanna C Wright

(74) *Attorney, Agent, or Firm* — Lucas & Mercanti, LLP

(57) ABSTRACT

A drilling machine having: a string of telescopic rods provided with an excavation tool; a winch having a drum associated with a motor; a flexible pulling element connected on the one hand to the drum and on the other hand to the string of telescopic rods; a manual control element of the winch that can assume a first position, a second position and a third position; a control system configured for controlling the motor, in a first operating mode, so as to unwind the flexible pulling element from the drum when the manual control element is in the first position, wind the flexible pulling element on the drum in order to raise the string of telescopic rods when the manual control element is in the second position, stop the drum when the manual control element is in the third position; wherein it comprises a first manual selector adapted to select a second operating mode, and in that the control system is configured for controlling the motor, in the second operating mode, so as to wind the flexible pulling element on the drum in order to tension the flexible pulling element without raising the string of telescopic rods when the manual control element assumes the third position.

14 Claims, 12 Drawing Sheets

DRILLING MACHINE

CROSS-REFERENCE TO RELATED APPLICATION

This application claims the benefit of Italian Patent Application No. 102016000090502 filed Sep. 7, 2016, the contents of which are incorporated herein by reference.

FIELD OF THE INVENTION

The present invention relates to a machine for drilling land or rock formations.

BACKGROUND OF THE INVENTION

In making foundation and land reinforcement excavations, self-propelled drilling machines are generally used, having a frame on wheels or a support track, lifting winches for excavation accessories and a turret rotating on fifth wheel coupled to the support track and comprising a cabin and control accessories. The rotating turret is generally provided with a power unit, such as a thermal motor or an electric motor for the cabin, for the control accessories and typically for the hoisting winches.

The machine comprises a tower provided with sliding guides on which a rotary table (in the sector also named as "rotary") moves linearly associated with the excavation accessories of the machine, for example a string of rods or an excavation tool. The rotary table, in particular, receives power, for example hydraulic or electric power, from the power unit and converts it into a rotary movement adapted to move the excavation tools.

The tower is superiorly delimited by a head comprising a plurality of pulleys for returning one or more cables, through which the hoisting winches located on the turret or on the tower itself raise or lower the excavation accessories. The latter are generally axially released but not radially from the rotary table that has an independent raising/lowering system.

In cases in which very high excavation depths are required, the technical solution typically used is to apply the excavation tools to a string of telescopic rods (also referred to in the industry as "kelly"). This string of rods generally consists of multiple rods of decreasing section axially sliding within each other and capable of transmitting to each other the rotary motion and the thrust forces required to advance.

The strings of telescopic rods are generally divided into two types, friction rods and mechanical locking rods.

In friction rods, the torque between the rods is normally transmitted through longitudinal strips welded along the elements that make up the rod, both internally and externally, in order to engage with each other.

The transmission of the axial thrust between the rods therefore takes place by means of the friction between the strips of the rods that is generated in the presence of torque.

The rotary table then has a coupling sleeve also provided with a plurality of strips adapted to engage with the corresponding strips of the outermost rod of the string.

In this way, the outermost rod of the string of rods receives the rotary motion from the rotary table through the engagement between the strips of the sleeve and the outer strips of the rod, while the axial thrust transmission takes place by means of the friction between the strips of the sleeve and those of the outermost rod that is generated in the presence of applied torque. In the absence of applied torque, the rods are axially mutually slidable and the entire string is slidable with respect to the rotary table and is moved by a suitable flexible element, preferably by cable.

In the case of mechanical locking rods, seats are generally formed on the outermost rod of the string, at the top, at the base and sometimes also in intermediate position, where the strips of the sleeve of the rotary table are engaged, thus remaining axially locked. In this way, both the torque and the thrust can be transmitted through a stop with mechanical abutment on the strips and not only by friction. When the strips of the sleeve are engaged in the seats of the outermost rod, it is axially constrained to the rotary. Through a rotation of the rotary table in the opposite direction, the strips of the sleeve can be disengaged from the seats of the rod, thus making the rod slidable relative to the rotary. For transmitting torque and thrust between the rods, the system is the same: a sleeve is formed on the bottom of each rod with strips facing inwards, which engage in the seats of the innermost rod.

During the excavation, the rods in the string are progressively extracted with the descent. By descending deeper, the innermost rods continue the descent until reaching a limit position in which they are completely extracted and stop in mechanical abutment on the respective outermost contiguous rods, while the outermost rod of the string is in abutment against the rotary.

At the end of the excavation step, in order to extract the tool from the ground it is necessary to return the string of rods to the retracted configuration of minimum length. This is possible through the actuation of a winch, generally referred to as main winch, typically mounted on the turret whose cable after being returned on the tower head connects to the upper end of the innermost rod of the string of rods that makes up the kelly rod. The winding of the cable on the drum of the main winch causes the raise of the innermost rod, which at the end of its stroke progressively drags the intermediate rods and then progressively the more external ones.

A dedicated system then allows the sliding of the rotary table on the tower. This dedicated system may comprise a hydraulic cylinder, for example of the long-stroke type or of the multi-extension type; in this case, the rotary table can be moved along the first lower half of the tower. Alternatively, the dedicated system may comprise a further winch, in the sector referred to as pull-down winch that allows the sliding of the rotary table by the entire length of the tower. Typically, the pull-down winch, when present, is mounted almost exclusively on the tower and not onto the turret of the machine and is returned on the tower ends to exert pull and thrust forces on the rotary.

In order to reduce the oscillations and the front and lateral deviations of the string of telescopic rods with respect to the tower during the excavation, there may be a rod guide head sliding on the tower and connected to the upper end of the outermost rod of the string. This connection allows the rotation of the strings but prevents the relative axial sliding between the string and the rod guide head which is then dragged by the string of rods when the latter slides with respect to the tower. The rod guide head performs a function of containment of the radial oscillations of the kelly rod ends, especially when executing inclined or not perfectly vertical excavations.

With particular reference to FIGS. 1A and 1B, they show a known type of drilling machine 100, provided with a kinematism 2, preferably parallelogram, for moving a guide tower 5 with respect to a rotating turret 3 mounted on a self-propelled carriage 4. The turret comprises a control cabin for the operator. Actuating kinematism 2 can allow moving tower 5 both for adjusting the drilling height with respect to the fifth wheel center, and for adjusting the inclination with respect to the ground level. Actuating the parallelogram kinematism 2 allows translating a tower 5 between two positions at different working radius, keeping the inclination constant, or allows the raising or lowering of tower 5, as well as limited movements of lateral inclination, or swing, by adjusting the inclination thereof with respect to the ground level. These movements are made possible also through a swivel joint 6, such a cardan joint, interposed between tower 5 and kinematism 2. On tower 5 there is a rotary table, or rotary 10 provided with a pull push system 11 per se known. A drilling assembly, such as a string of telescopic rods or kelly 12 is placed through the rotary table 10.

The string of telescopic rods 12 is guided in the lower part by the sleeve of the rotary table 10 and in the upper part by a rod guide head 13. An excavation tool 15, which may consist, for example, of a bucket or a screw auger, is fixed to the lower end of the innermost rod of the string of rods 12 so as to receive torque and thrust from said rod.

The movement of the telescopic rods 12 occurs through a winch 8, also referred to as main winch, carried by turret 3 of the machine and configured to allow the winding or unwinding of a traction element 9, such as a cable, which is attached to winch 8 and, after being returned on head 7 of the guide tower, is constrained to the innermost rod of the string of rods 12. In particular, the connection between cable 9 and the innermost rod of the string takes place through the interposition of a swivel joint 14 of a known type. The swivel joint 14 has the function of preventing the transmission of torque between the inner string of the string of rods 12 and cable 9 of the winch, thus preventing the cable from being dragged in rotation by the rotary motion of the rods, and thus preventing the cable from twisting.

FIG. 2A shows a sectional view of the string of rods 12 and of the swivel joint 14 that permits to visualize how the connection between cable 9 and the inner rod is implemented through joint 14. FIGS. 2A and 2B show the string of rods in a condition in which the innermost rod 12A is completely extracted with respect to the immediately outermore rod 12B and with the respective strips in mechanical abutment in order to transmit the torque between the two rods. The inner rod 12A is provided at its upper end with a connection with a seat for a pin designed to connect the swivel joint 14 with the rod. The swivel joint 14 has a substantially cylindrical shape and consists of two parts, a lower half-joint 14A and an upper half-joint 14B, which are axially constrained to one another in the direction of the longitudinal axis of the joint but which are released in rotation, being able to rotate relative to one another about the longitudinal axis of the joint, due to the presence of special bearings interposed between the parts. The lower half-joint 14A is provided with connections for connecting to the upper connection of rod 12A via a hinge pin. Joint 14 is therefore tilting with respect to the connection of the inner rod 12A. The upper half-joint 14B is provided with connections for connecting to the terminal of cable 9 via a hinge pin. Joint 14 has a suitable diameter, preferably smaller than the diameter of rod 12A in order to be insertable within all the telescopic rods that make up string 12, following the sliding of the inner rod without scraping or contacting the outer rods. When cable 9 is tensioned, the swivel joint 14 is arranged with its axis aligned and substantially matching the longitudinal axis of the string of rods 12. When the rods are set in rotation, the lower half-joint 14A rotates integrally with the rods, while the upper half-joint 14B does not rotate and does not transmit rotations to cable 9.

When executing foundation piles using a known type of machine 100, the operator must pay particular attention during all the steps of the excavation and especially during the rotation steps of the rods, to keep cable 9 tensioned to ensure that the swivel joint 14 remains coaxial with the same rods. In fact, if the cable underwent a loosening greater than a minimum acceptable value, the swivel joint 14, being tilting with respect to the connection of rod 12A, would tend to arrange itself inclined and to come into contact with the inner walls of the other rods, thus becoming damaged and also damaging cable 9.

The excavation generally has a first step in which the machine is positioned in the proximity of the pre-hole, or the excavation location indication peg and by adjusting the kinematism, the excavation tool is positioned on the axis of the hole to be made. A plurality of subsequent excavation steps is then carried out; in fact, during the excavation, the excavation tool fills up or charges with the excavated soil and it is necessary, therefore, to cyclically return it to the surface and empty it. Therefore, filling cycles of the excavation tool indicate the excavation steps in which the tool is filled with the excavated soil.

The first excavation step is performed in the virgin soil by making a hole having a depth about equal to the excavation tool.

Once the hole has been started, to prevent the risk of loosening of the cable, the operators of drilling machines of known type proceed with the advancement of the excavation according to the following steps for each filling cycle of the excavation tool:

- The excavation tool 15 is descended into the hole by unwinding the cable of the main winch 8 so that the telescopic rods of the string 12 are extracted. The actuation of winch 8 is controlled by actuating a control member, typically a joystick or a dedicated maneuvering manipulator present in the control cabin of the machine.
- During the descent of the excavation tool 15 into hole partially made, the operator must check the indicator of the depth reached by the excavation tool 15, commonly called depth gauge, present in the cabin. Before the excavation tool 15 reaches the bottom of the excavation, that is the depth reached during the previous filling cycle of the tool, the operator slows the descent of the tool by acting on the joystick that controls the unwinding of the cable from the winch. The descent is slowed down until it is stopped as close as possible to the bottom.
- When the operator stops the descent, if the excavation tool 15 is in the proximity of the bottom of the excavation and cable 9 is tensioned, no correction maneuver is required. If instead the excavation tool 15 has reached the bottom leaning thereon and cable 9 is loose and no longer substantially straight in the vertical direction, the operator must correct the configuration of cable 9 by acting on the joystick and rewinding the winch a little until cable 9 is tensioned again. The operator in the cabin can visually check if cable 9 is tensioned, as it exits the excavation and continues towards head 7 on which it is returned.
- The operator activates the "winch release mode" via a command, preferably by pedal, present in the cabin. In this mode, the main winch 8 is left only slightly braked. For example in these conditions, a pull of 600-700 kg induced by a load on the cable is sufficient to make the winch turn, thus overcoming the braking. In this condition, i.e. in "winch release mode" active, the excavation tool 15 leans on the bottom due to its own weight and the weight of the rods which is much higher than the pull sufficient to unwind the winch.

With the excavation tool 15 resting on the bottom of the excavation, the operator controls the rotation of the rods, preferably without applying thrust to the tool. The rotation of the rods is activated through a joystick in the cabin that controls the rotation of rotary 10. During this rotation, the "winch release mode" is still active. The excavation tool 15, due to its structure, of the screw type in the case of auger or with ploughshare lower opening in the case of buckets, tends to advance in the soil in screwing and thus tensions the inner rod 12A, which slides downwards, and consequently cable 9, which remains tensioned during the advance of the tool. The advancement is at most equal to the height of the tool itself.

If a thrust force must be exerted on the tool to advance it, it is necessary that all the rods of string 12 are mutually engaged and that the outermost rod 12B is engaged with respect to the sleeve of the rotary. Thereafter, rotary 10 is moved downwards with the pull push system 11 of a known type and the excavation is executed.

The excavation tool 15 is extracted by maneuvering the winding of cable 9 through the rotation of the main winch 8. This winding returns the rods, packing them up to make the tool and the same rods exit from the excavation.

The drilling machines of known type have the drawback that it is difficult for the operator to be able to maintain cable 9 tensioned during all the excavation steps. Therefore, frequently problems occur due to the loosening of cable 9.

In fact, for example, if the operator is late in stopping the descent into the excavation, the excavation tool 15 touches the bottom of the excavation, thus stopping, and cable 9 due to the inertia due to the weight of all the suspended section of cable that goes from the swivel joint 14 to the pulley in head 7, tends to continue to unwind for a short stretch, thus dragging the main winch 8 into rotation. Few centimetres of excessive unwinding are sufficient to create the problem of the loosening of cable 9, i.e. of removal from the straight configuration of the cable itself, and said problem gets worse if, once the tool has reached the bottom, the operator continues to keep the joystick that controls the unwinding of the cable actuated. In this case, there may be tens of centimetres of excess unwound cable.

The loosening of the cable can occur also in the case that the excavation tool 15 encounters obstacles during the descent in the stretch of hole previously excavated. For example, the excavation tool 15 may rest on a portion of collapsed wall. In this case, the excavation tool 15 stops or slows down its descent speed with respect to the unwinding speed of cable 9 from winch 8. This leads to a reduction of tension on the cable, whereby it tends to bend.

When cable 9 is loosened, the swivel joint 14 which connects the inner rod 12A to cable 9 is arranged inclined, as shown in FIG. 2B, until it rests against on the inner wall of the outer rod 12B. In this condition, the swivel joint 14 does not operate properly and does not perform its function of releasing cable 9 from the rotation of rods 12. If in this condition, i.e. with inclined swivel joint 14, the operator controls the rotation of the rods without having first proceeded to tension the cable by rewinding it on winch 8, it happens that both half-joints 14A and 14B of the swivel joint 14 revolve together with rod 12A, and thus the upper half-joint 14B performs an eccentric trajectory with respect to the longitudinal axis of the rods. This eccentric movement of the upper half-joint 14B causes the twisting of the cable, which leads to rapid wear and tear of the cable itself.

In addition, the loosening of cable 9 and its arrangement in non-straight configuration can cause vibrations during the rotation of the string of rods 12 and thus an oscillation of the rods that may impair the correct execution of the excavation.

An excessive loosening of cable 9 can also cause an incorrect winding of cable 9 itself, which being arranged incorrectly on the drum may undergo early wear or plastic deformation that lead to breakage.

SUMMARY AND OBJECTS OF THE INVENTION

The object of the present invention is to overcome the drawbacks mentioned above and in particular to devise a drilling machine that permits to reduce the risk of problems caused by the loosening of the handling cable of the string of rods in a simple and easy manner for the operator.

This and other objects according to the present invention are achieved by making a drilling machine as described in claim 1.

Further features of the drilling machine are the object of the dependent claims.

BRIEF DESCRIPTION OF THE DRAWINGS

The features and the advantages of a drilling machine according to the present invention will become apparent from the following exemplary and non-limiting description, made with reference to the accompanying schematic drawings, in which.

DETAILED DESCRIPTION OF THE INVENTION

Figure 1A:
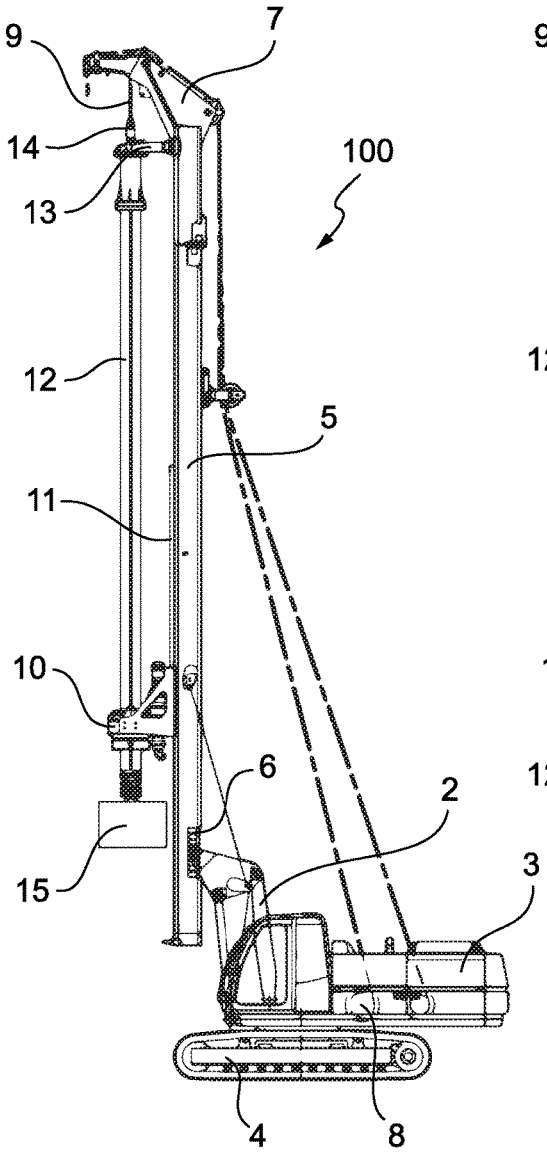
Fig. 1A PRIOR ART
FIGS. 1A and 1B are two side elevation views of a drilling machine for the construction of piles according to the prior art, respectively in a first configuration with the string of rods fully retracted/packed and in a second configuration with the string of rods at least partially extended/extracted.
Figure 1B:
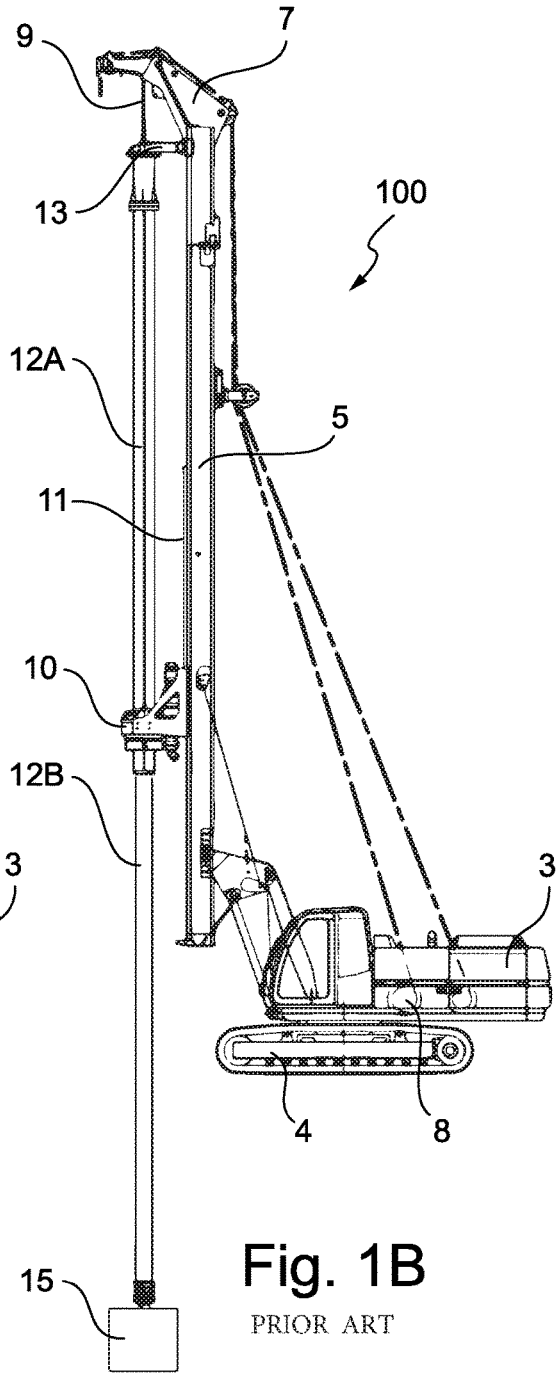
Fig. 1B PRIOR ART
Figure 2A:
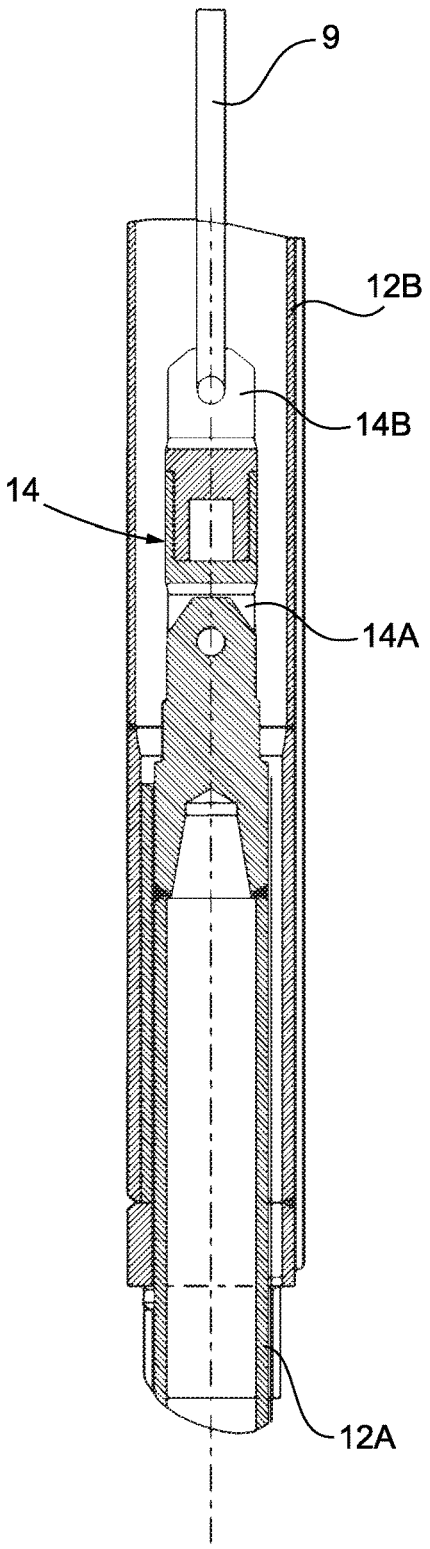
Fig. 2A PRIOR ART
FIGS. 2A and 2B are two sectional views of a detail of two consecutive rods of the string of rods of FIG. 1; these figures show the connection between the handling cable of the rods and the innermost rod of the string of rods through a swivel joint in a configuration aligned with the rods in FIG. 2A and in inclined condition with respect to the longitudinal axis of the rods in FIG. 2B.
Figure 2B:
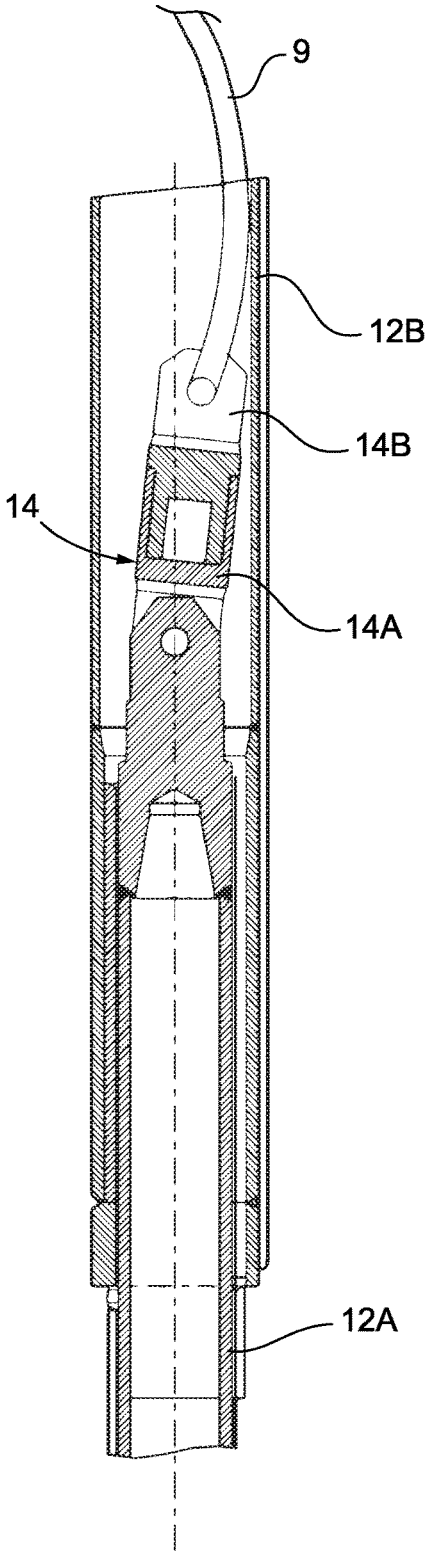
Fig. 2B PRIOR ART
Figure 3:
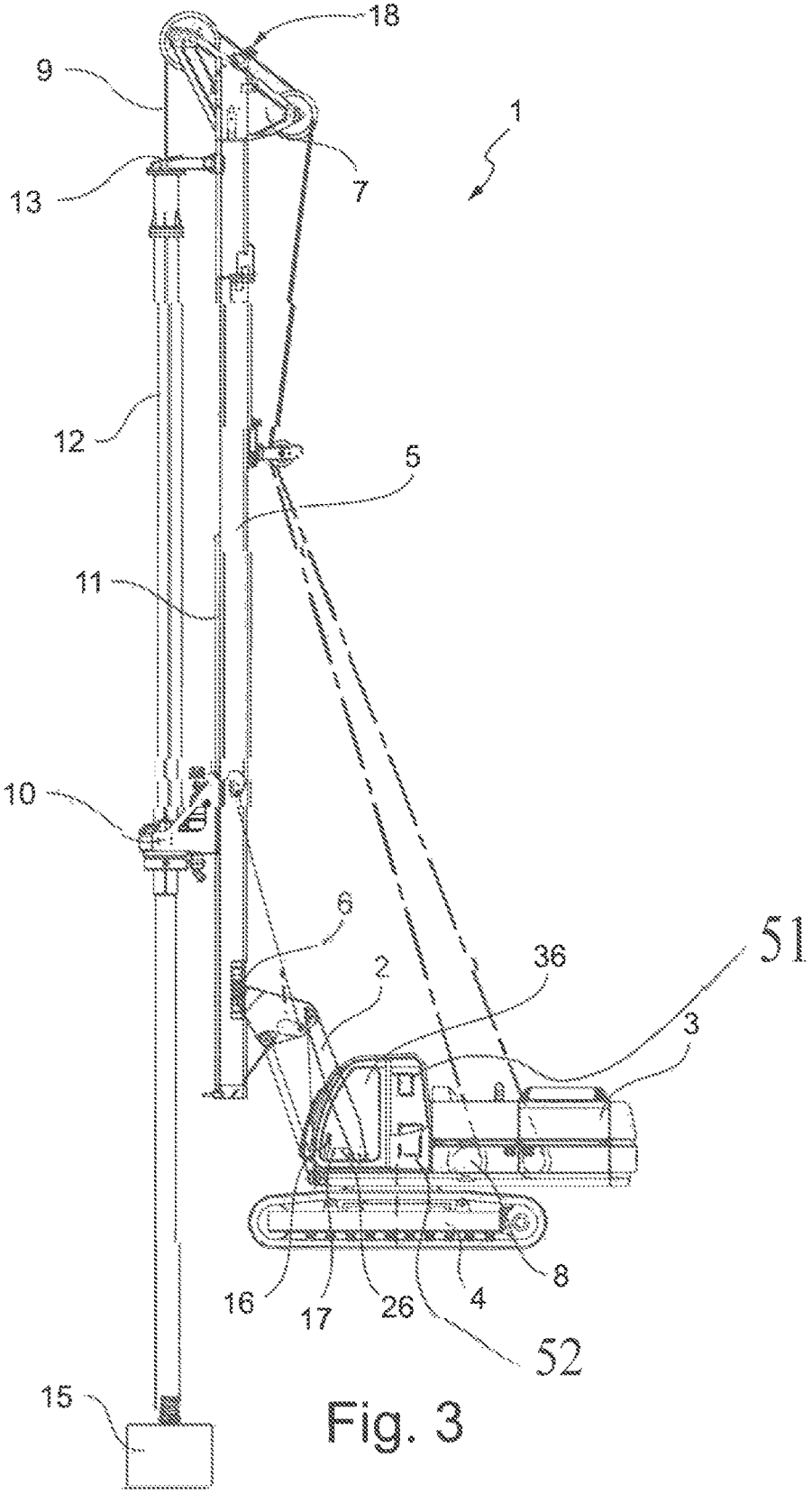
FIG. 3 is a side elevation view of an embodiment of the drilling machine according to the present invention with the string of rods at least partially extended/extracted.

With reference to FIG. 3, a drilling machine is shown, indicated as a whole with reference numeral 1. Details and elements similar, or having a function similar, to those of the known drilling machine 100 described above, are associated with the same alphanumeric references.

The drilling machine 1 comprises a machine body in turn comprising a self-propelled carriage 4 and a rotating turret 3. The rotating turret 3 comprises a control cabin 36 for the operator.

The drilling machine 1 further comprises a guide tower 5 and a kinematism 2, preferably a parallelogram, for moving the guide tower 5 with respect to the rotating turret 3.

Kinematism 2 is connected on the one hand to the rotating turret 3 and on the other hand to the guide tower 3. In particular, kinematism 2 is connected to the guide tower 3 by the interposition of an articulated joint 6, such a cardan joint.

The guide tower 5 is slidably coupled to a rotary table 10 associated with a pull push system 11 known per se. The rotary table 10 is associated with a string of telescopic rods 12 or kelly. The string of telescopic rods 12 is guided in the lower part by the rotary table 10 and can be driven in the upper part by a rod-guide head 13.

The string of telescopic rods 12 is provided with an excavation tool 15 which may for example be a bucket or a screw auger; in particular, the excavation tool 15 is fixed to the lower end of the innermost rod of the string of telescopic rods 12 so they as to receive torque and thrust from said rod.

The drilling machine 1 comprises a winch 8, also known as main winch, comprising a drum 8 associated with a motor 23 designed to actuate drum 8 in rotation. Winch 8 is advantageously arranged on the rotating turret 3, as can be seen in FIG. 3; more in general, winch 8 can be arranged elsewhere, for example applied to the guide tower 5.

The drilling machine 1 comprises a flexible pulling element 9, for example a cable, connected on the one hand to drum 8 and on the other hand to the string of telescopic rods 12 so as to be unwound or wound on drum 8 to move the string of telescopic rods 12. In detail, this flexible pulling element 9 is fastened at one end to the winch 8, returned on a head 7 of the guide tower 3 and fastened at the other end to the innermost rod of the string of rods 12. In particular, the connection between cable 9 and the innermost rod of the string of rods takes place through the interposition of a swivel joint 14 of a known type.

The drilling machine 1 further comprises a manual control element 16 of the winch 8 which can take at least a first position, a second position and a third position. For example, the manual control element may be a control lever or joystick located in the control cabin 36 of the rotating turret 3.

The drilling machine 1 advantageously comprises a control system associated with the manual control element 16; such a control system is, in particular, configured for controlling motor 23, in a first operating mode, so as to unwind the flexible pulling element 9 from the drum 8 in order to lower the string of telescopic rods 12 when the manual control element 16 is in the first position, wind the flexible pulling element 9 on drum 8 in order to raise the string of telescopic rods 12 when the manual control element 16 is in the second position, stop drum 8 when the manual control element 16 is in the third position.

The drilling machine 1 further comprises an auxiliary control element (not shown), preferably a pedal present in the control cabin 36, adapted to activate the "winch release mode" described above.

According to the present invention, the drilling machine 1 comprises a first manual selector 26 associated with the control system and adapted to select at least a second operating mode; in this case, the control system is configured for controlling motor 23, in the second operating mode, so as to wind the flexible pulling element 9 on drum 8 in order to tension the flexible pulling element 9 without raising the string of telescopic rods 12 when the manual control element 16 assumes the third position.

In both operating modes, the first and the second position of the manual control element 16 correspond to the raising or descent control, respectively, of the string of telescopic rods 12 and thus of the excavation tool 15. When manual control element 16 is in the first or second position, therefore, the control system controls motor 23 so that the latter imparts a rotation to drum 8 such as to lower or raise the string of telescopic rods 12.

The third position of the manual control element 16 instead corresponds in the first operating mode to the stop of drum 8, while in the second operating mode to the rewinding of the flexible pulling element 9 with reduced pull. In fact, in the second operating mode, when the manual control element 16 is in the third position, the control system controls motor 23 so that the latter imparts a rotation to drum 8 such as to tension the flexible pulling element 9 but not sufficient to raise the string of telescopic rods 12. Preferably, the first manual selector 26 may be for example a button that when pressed, selects the second operating mode. More in general, the first manual selector 26 may be a two-position selector to select the first or the second operating mode. Also the first manual selector 26 is advantageously arranged in the control cabin 36 of the rotating turret 3 available to the operator who can thus easily select the operating modes of the control system.

If the second operating mode is activated, the control system activates the rewinding of the flexible pulling element 9 at reduced pull as long as the manual control element 16 remains in said third position and more preferably as long as the operator does not control one of the following maneuvers:

raising or descent of the excavation tool 15;

activation of the "winch release mode" already described above;

rotation of rods and tool by controlling the rotary.

In fact, if the operator controls a descent of the excavation tool 15, the winding at reduced pull of the flexible pulling element 9 must be deactivated as it would act contrary to the desired maneuver.

If the operator controls a raising of the excavation tool 15, the reduced pull winding of the flexible pulling element 9 must be deactivated as the flexible pulling element 9 would not exert a pulling force needed to raise the string of rods 12.

If the operator activates the "winch release mode", it means that he wants to rest the tool on the bottom and then begin the rotation. In this case, it is necessary that the winding at a reduced pull of the flexible pulling element 9 is deactivated as during the rotation of the excavation tool 15 it tends to advance in the ground, and thus a possible pull of the flexible pulling element 9, albeit reduced, would hinder this advancement.

Likewise, as just said, as long as the operator carries out the rotation of the rods, the winding at a reduced pull of the flexible pulling element 9 must be deactivated.

Preferably, the drilling machine 1 may comprise a detection device 18 connected to the control system and configured for detecting a loosening of the flexible pulling element 9. In this case, the control system is also configured to stop drum 8 when the detection device 18 detects a loosening of the flexible pulling element 9.

Figure 4:
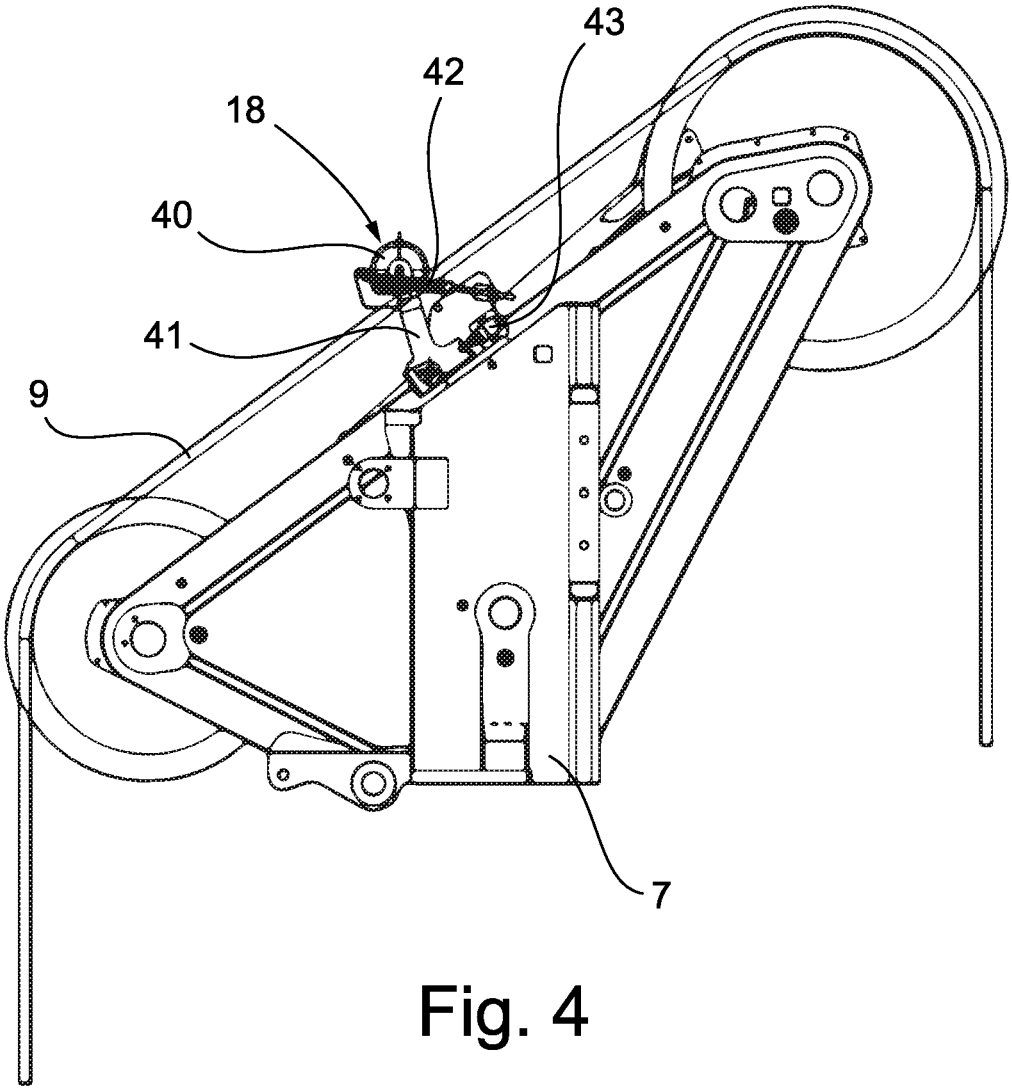
FIG. 4 shows a detection device of a loosening of the handling cable of the string of rods comprised in the machine of FIG. 3.

Preferably, as in the embodiment shown in FIG. 4, the detection device 18 comprises a roller 18 mounted on an arm leverage 41 rotatably associated with the guide tower 5 and a return element 42, such as a spring, constrained on the one hand to the guide tower 5 and on the other hand to the arm leverage 41. In particular, the return element 42 is designed to act on the arm leverage 41 so that roller 40 is pressed against the flexible pulling element 9. The detection device 18 further comprises a control device 43, such as a microswitch, associated with the arm leverage 41 and arranged to activate and to pilot the control system so as to stop drum 8 when the angular position of the arm leverage 41 with respect to the guide tower 5 assumes a predefined value that corresponds to the loosing of the flexible pulling element 9.

The return element 42, in detail, tends to rotate the arm until the roller 40 leans on the flexible pulling element 9 of the winch 8. The arm leverage 41 interacts with the control device 43 that is activated or deactivated by the angular position of the arm leverage 41.

Preferably, the detection device 18 is placed on the guide tower 5 on head 7 of the guide tower 5 and in particular at an intermediate point between two head return pulleys, as shown in FIG. 4. More generally, the detection device 18 may be positioned at any point of the guide tower 5.

Roller 40 is kept pressed on the flexible pulling element 9 and as long as the flexible pulling element 9 is tensioned, the control device 43 is not activated. During the descent step of the excavation tool 15, which occurs by rotation of winch 8 to allow unwinding the flexible pulling element 9, if there occurs a loosening of the flexible pulling element 9, such a loosening is detected by device 18. The loosening of the flexible pulling element 9 in fact causes a deflection of the flexible pulling element 9 and roller 40, driven by the action of the return element 42, follows this deflection thereby generating the rotation of the arm leverage 41 and the consequent activation of the control device 43. This loosening may occur when the excavation tool 15 reaches the bottom of the excavation or if it encounters obstacles that prevent or slow the descent thereof.

Preferably, the drilling machine 1 comprises one or more sensors 51 (not shown) designed to detect the depth and rate of raising or descent of the excavation tool 15 and an electronic processing and control unit 52 connected to such one or more sensors. Such an electronic processing and control unit is advantageously configured for storing the maximum depth reached by the excavation tool 15 at the end of each excavation phase, and for outputting an alert signal for an operator when at least one of the following events occurs:

- during the descent, the excavation tool 15 reaches a depth at a predetermined distance from the maximum stored depth reached by the excavation tool 15;
- the excavation tool 15 descends at a descent speed higher than a preset threshold value.

The threshold value of the descent speed may be set by the operator and stored in the electronic processing and control unit.

The depth at which the excavation tool 15 is located may for example be measured by an encoder mounted on winch 8. Again through the detection of such an encoder, the electronic processing and control unit is able to calculate the descent speed of the excavation tool 15 according to the rotations carried out by winch 8 per unit of time.

The electronic processing and control unit continually monitors the depth of the excavation tool 15 and stores the maximum depth reached at the end of the current excavation step. After each emptying phase of the tool, when a new excavation phase is begun and the excavation tool 15 is again lowered into the hole, the electronic processing and control unit therefore knows the maximum depth reached during the previous excavation phase regarding that hole.

When the excavation tool 15 is about to reach the maximum depth stored or if it descends at a higher speed than the above preset threshold value, an alert signal is generated for the operator.

Preferably, the drilling machine 1 comprises a display, such as a monitor, connected to the electronic processing and control unit and the alert signal is displayed on the display. In this case, therefore, the alert signal is a "pop-up" that is displayed on the monitor. Alternatively, the alert signal may be any audible beep.

Preferably, the drilling machine 1 comprises a second manual selector 17 arranged to select a slowed down descent mode of the excavation tool 15 and the control system is configured for controlling motor 23 in order to lower the excavation tool 15 at a predefined speed when the slowed down descent mode is selected. Such a predefined speed is of course slower than that used during the normal descent of the excavation tool 15.

The manual selector 17 may for example be a button and is preferably positioned on the manual control element 16, but alternatively it may be in another part of the control cabin 36 easily accessible by the operator. The alert signal for the operator may serve for suggesting the slowing down of the descent of the excavation tool 15.

Figure 6:
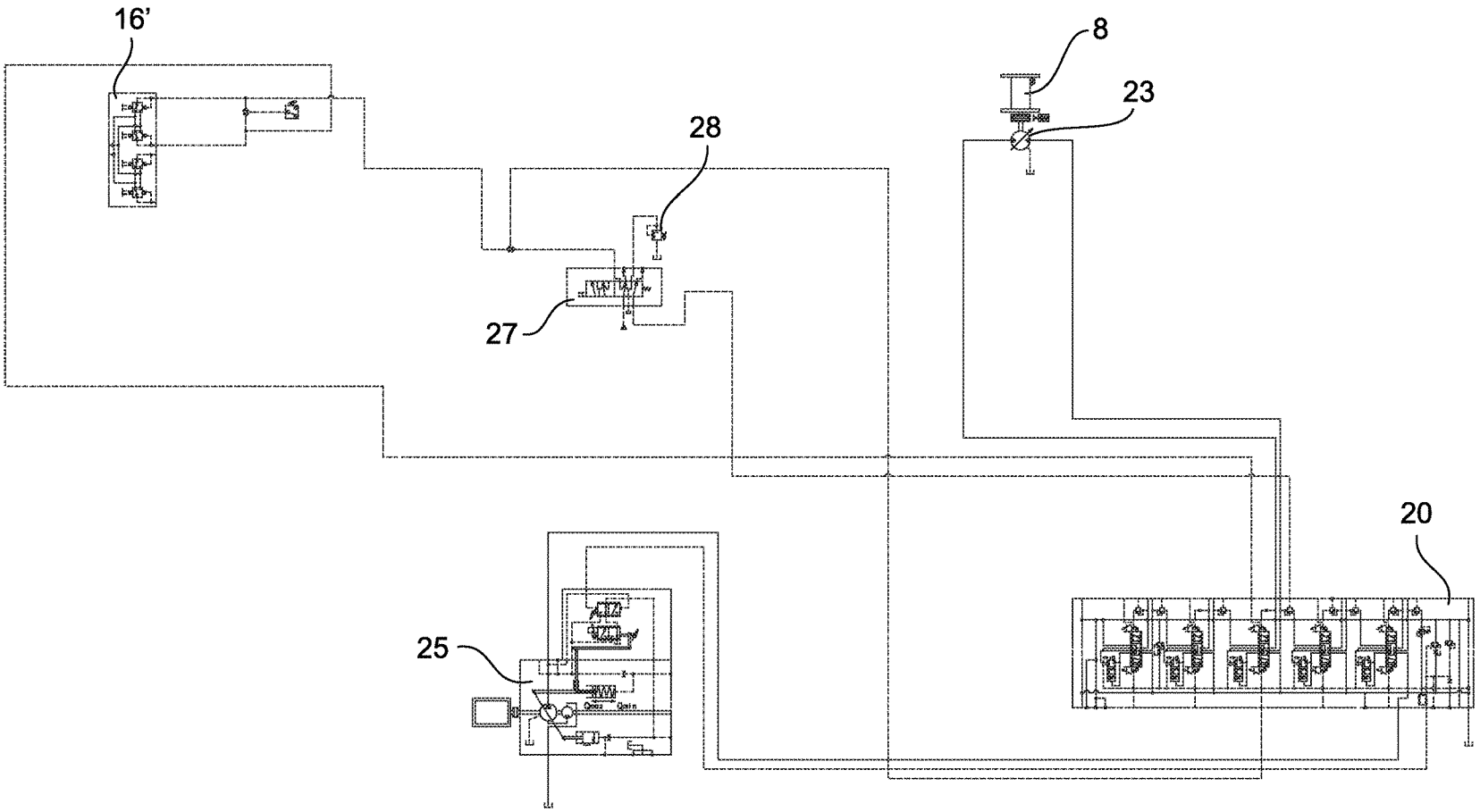
FIG. 6 is a schematic partial view of a control system of a drilling machine according to a first embodiment of the present invention.

With reference to FIG. 6, the control system preferably comprises a pump 25 which feeds a distributor designed to hydraulically control motor 23 based on hydraulic pilot signals, a hydraulic control unit 16' of the manual control element 16 hydraulically connected to distributor 20 and a first valve assembly 27, 28 hydraulically connected to the hydraulic control unit 16' of the manual control element 16 and to distributor 20 and electrically connected to the first manual selector 26.

The hydraulic control unit 16' of the manual control element 16 is therefore able to send hydraulic pilot signals to distributor 20 to actuate motor 23 to control the raise or descent of the string of rods 12 and of the excavation tool 15.

The first valve assembly 27, 28 is instead capable of hydraulically piloting distributor 20 when the second operating mode is active and the manual control element 16 is in the third position.

Selecting the second operating mode with the first manual selector 26 electrically activates a solenoid valve 27 of the first valve assembly 27, 28 which sends a hydraulic piloting signal to distributor 20, which in the presence of such a hydraulic piloting signal activates the rotation of motor 23 of winch 8 to wind the flexible pulling element 9. During this rotation, the pull of winch 8 generated on the flexible pulling element 9 is reduced, thus reducing the pressure of the piloting signal which goes from the solenoid valve 27 to distributor 20. The reduction of the piloting pressure takes place by means of a maximum pressure limitation valve 28 of the mechanical type. The reduction of the piloting pressure causes a reduction of the supply pressure of motor 23 and thus a reduction in its strength, while the winding speed of winch 8 remains high. The pressure reduction of the winch pull is selected so that the winch has a sufficient pull to recover the loosening of the flexible pulling element 9 by quickly returning it tensioned, but at the same time it has a much smaller pull than is necessary for moving the string of telescopic rods 12.

Figure 7:
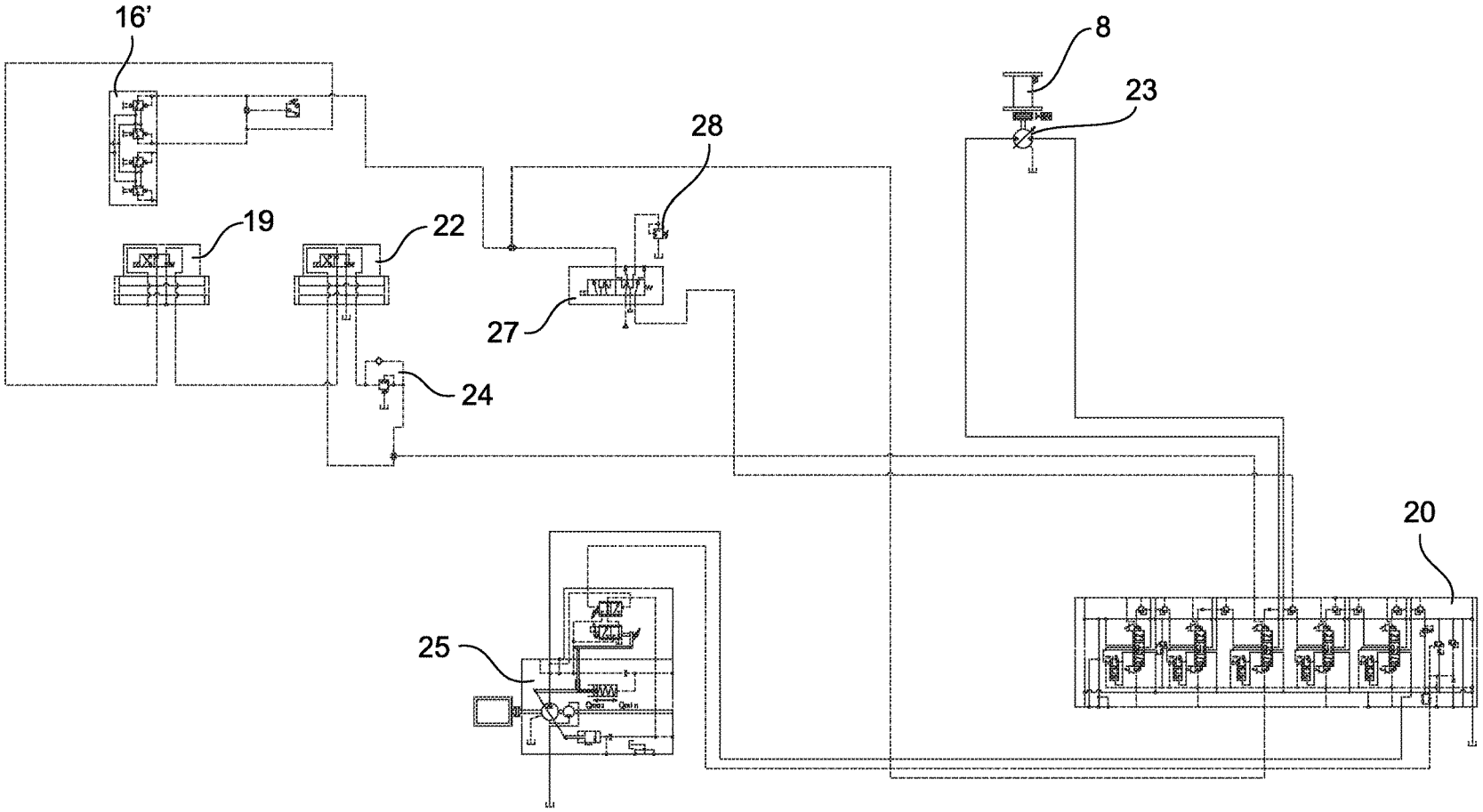
FIG. 7 is a schematic partial view of a control system of a drilling machine according to a second embodiment of the present invention.

With reference to FIG. 7, the control system also comprises, in addition to the elements shown in FIG. 6, a second valve assembly 19, 22, 24 connected to distributor 20 and to the hydraulic control unit 16' of the manual control element 16.

The second valve assembly 19, 22, 24 is designed to control distributor 20 so as to allow or interrupt the piloting exerted by the hydraulic control unit 16' of the manual control element 16. The second valve assembly 19, 22, 24 is also designed to adjust the piloting signal of the control unit 16' so as to pilot distributor 20 to actuate motor 23 in the slowed descent mode.

In particular, when the control device 43 is activated, it intervenes by deactivating a first solenoid valve 19 of the second valve assembly 19, 22, 24, and in this way the piloting signal to distributor 20 is interrupted. In this condition, the distributor 20 does not feed the motor 23 of the winch 8 anymore, which stops. In this way, the control system intervenes very quickly, as just a minimum loosening of the flexible pulling element 9, corresponding to a few centimetres of the flexible pulling element 9 unwound in excess, is sufficient to activate the control device 43 and stop the winch 8. Stopping winch 8 avoids a further unwinding, and thus an excessive loosening, of the flexible pulling element 9. The operator, once the tool has reached the bottom, can then proceed immediately to the rotation of the excavation tool 15 since the flexible pulling element 9 will be sufficiently tensioned to ensure the proper arrangement of the swivel joint 14 and the correct winding in the subsequent ascent step.

When the second manual selector 17 selects the slowed descent mode of the excavation tool 15, a second solenoid valve 22 of the second valve assembly 19, 22, 24 is activated which connects the control line of the distributor 20 to a mechanical pressure reduction valve 24 calibrated at a predetermined fixed value.

In this way, the piloting signal coming from the hydraulic control unit 16' of the manual control element 16 must pass through the reduction valve 24 of the second valve assembly 19, 22, 24 which reduces the pressure thereof before it reaches the distributor 20. In this way, the reduced piloting pressure provokes a reduction in the oil flow rate that from the distributor 20 is sent to actuate the motor 23 of the winch 8 and the rotation speed thereof is reduced accordingly. During the first step of rapid descent into the excavation, when the first solenoid valve 22 of the second valve assembly 19, 22, 24 is not activated, the piloting pressure passes unchanged from said first solenoid valve 22 to distributor 20 with a pressure proportional to the position of the manual control element 16.

If the operator lowers the tool sufficiently slow, i.e. below the threshold value, when the tool reaches the bottom there will be only a minimal loosening of the flexible pulling element 9, sufficient to activate the control device 43 of the detection device 18 that will result in the stopping of the unwinding. The loosening will be sufficiently small to prevent the swivel joint 14 from arranging in incorrect positions and sufficiently small to ensure that in the next rewinding step, the flexible pulling element 9 will arrange correctly on the pulleys and on the drum of winch 8, thus avoiding wear and deformations of the flexible pulling element 9 itself.

Again with reference to the embodiment shown in FIG. 7, before descending with tool 15 into the hole, the operator activates the second operating mode via the first manual selector 26. The operator can quickly descend the excavation tool 15 and slow it down only in the last portion of descent through the second manual selector 17. If the operator continues to lower the excavation tool 15 too quickly in the final stretch of the excavation, he will be notified via a pop-up message on the display that prompts him to slow down and in this case, the operator will act on the second manual selector 17. As soon as the lowering maneuver is interrupted, returning the manual control element 16 to a neutral position, that is, in the third position, winch 8 is actuated according to the second operating mode to quickly rewind any excess unwinding of the flexible pulling element 9 and eliminating any loosening. If the operator reaches the bottom of the excavation without noticing it immediately, and thus continues to maintain the manual control element 16 in the first position, there would be an immediate intervention of the detection device 18, which by recognizing even a slightest loosening would send a winch stop signal according to the procedures already described. The operator at this point can proceed to the rotation of the rods and the advancement of the excavation.

Figure 5:
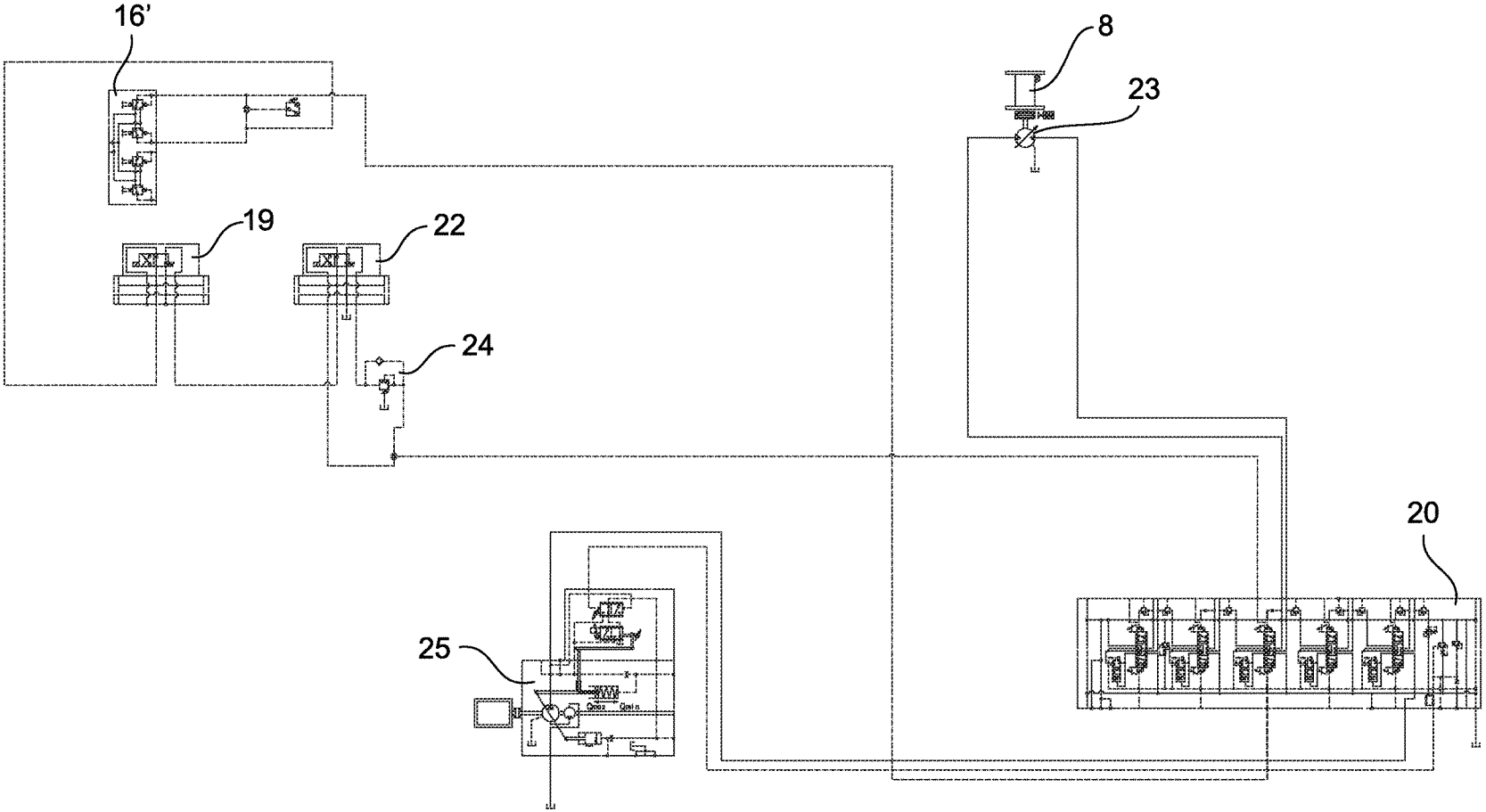
FIG. 5 is a schematic partial circuit view of a control system of a drilling machine.

With reference to the embodiment of FIG. 5, the control system comprises pump 25 which feeds distributor 20 designed to hydraulically pilot the motor 23, the hydraulic control unit 16' of the manual control element 16 hydraulically connected to the distributor 20 and the second valve assembly 19, 22, 24 connected to the distributor 20 and to the hydraulic control unit 16' of the manual control element 16. Practically, the embodiment of FIG. 5, unlike that of FIG. 7, does not provide the first valve assembly 27, 28. In this case, the control system is not able to function according to the second operating mode. According to the embodiment of FIG. 5, the second valve assembly 19, 22, 24 is designed to operate in a manner similar to that described for the embodiment of FIG. 7. In this embodiment, therefore, the slowed descent and the stopping of the winch is provided on the basis of the detection of the detection device 18. Preferably, the distributor 20 is of proportional type but may also be of non-proportional type.

Figure 8:
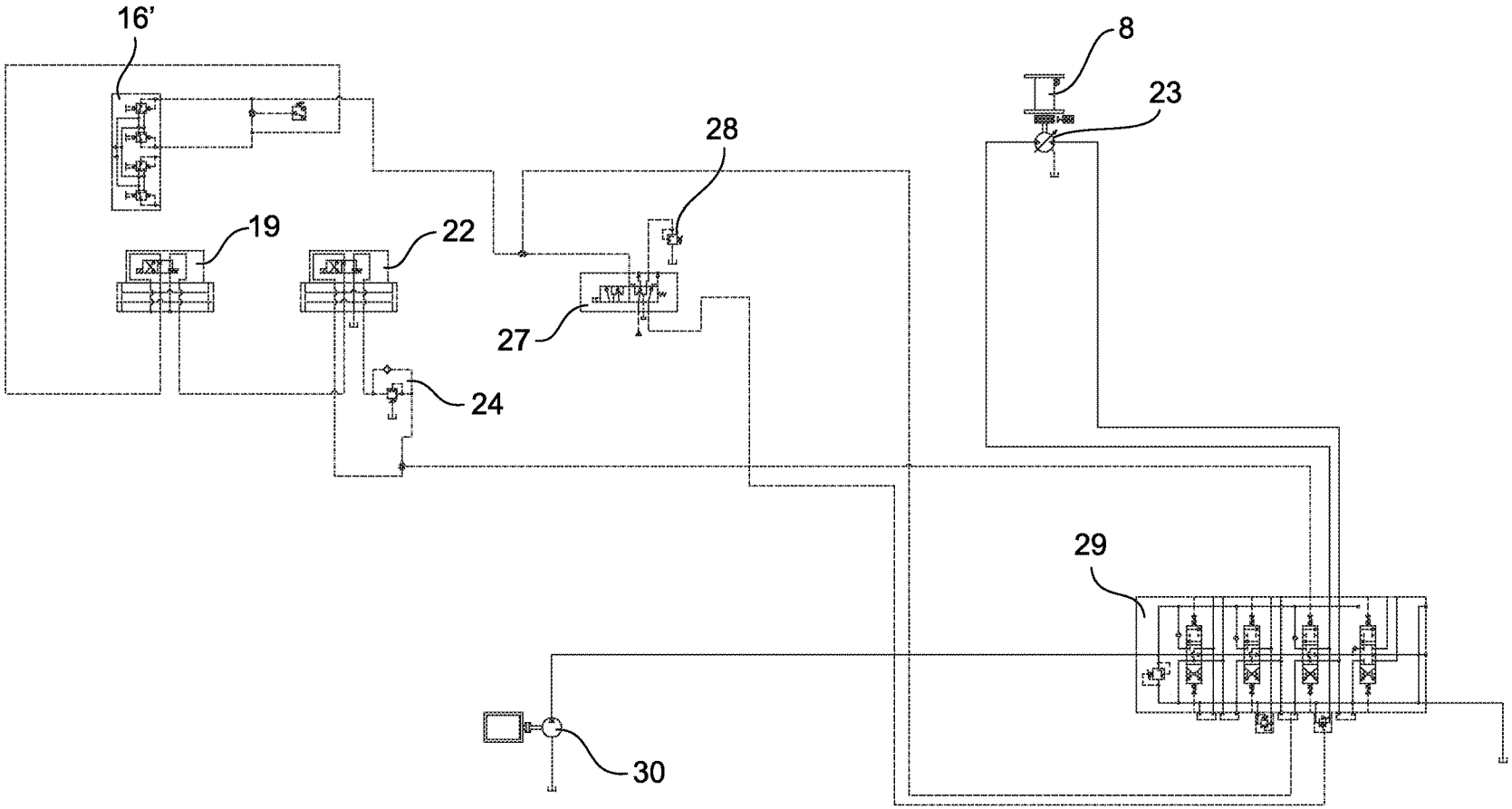
FIG. 8 is a schematic partial view of a control system of a drilling machine according to a third embodiment of the present invention.

In fact the control system, such as shown in FIGS. 5, 6 and 7, preferably comprises components with load-sensing type architecture, therefore the flow rate flowing in distributor 20, proportional and directed to winch 8, is independent of the load conditions. In fact, distributor 20 sends a certain flow rate in order to obtain a certain speed of the actuator and this speed is obtained regardless of the resistance which the actuator encounters. Therefore, for the same position of the manual control element 16, the winding has the same speed both if winch 8 winds without load and if winch 8 lifts a load. Therefore, the flow rate sent by distributor 20 to winch 8 is only function of the opening of the spool of distributor 20 relative to the winch control. The advantage of this architecture is an energy saving during operation in the second operating mode with respect to other architectures. With reference to FIG. 8, in a variant thereof the system may also be implemented using components with an architecture that is not load sensing, in particular a non-proportional distributor 29 and a fixed displacement pump 30. In this case, the operating logic of the drilling machine 1 is identical to the case described above for FIG. 7 except that it has a more dissipative system. The control system in this case wastes a larger amount of energy than the previous one, in particular if the second operating mode is activated. It is a more economical constructive solution which can be later implemented on machines that at the time of construction did not have an architecture of the control system of the load-sensing type.

Figure 9:
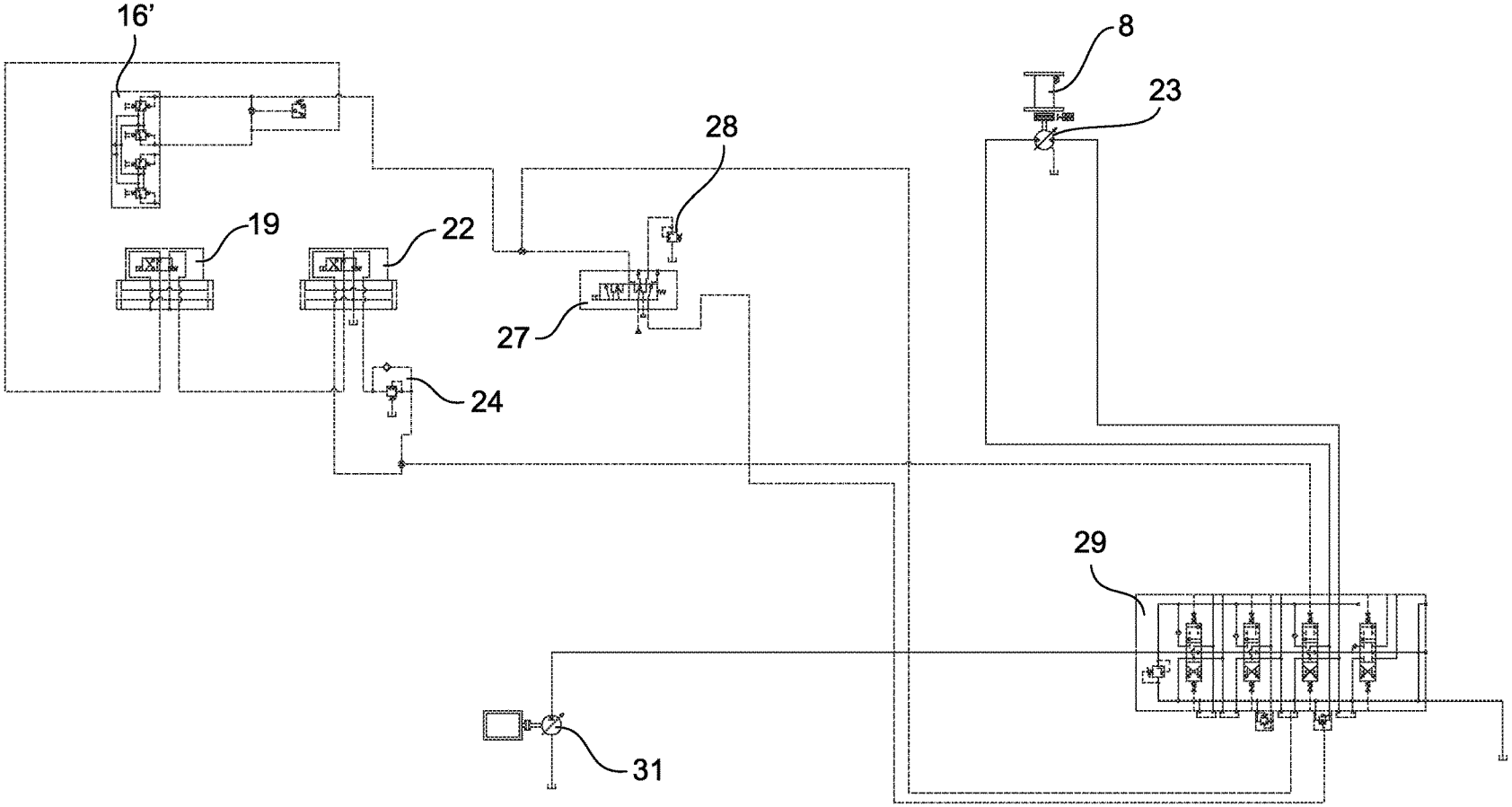
FIG. 9 is a schematic partial view of a control system of a drilling machine according to a fourth embodiment of the present invention.

With reference to FIG. 9, in a variant thereof the system may also be implemented using components with an architecture that is not load sensing but with an electric/hydraulic variation system of the displacement of the pump. In this case, the control system comprises a non-proportional distributor 29 and a variable displacement pump 31.

By exploiting the variation of the displacement of pump 31, a less dissipative system can be implemented. Once the flexible pulling element 9 is tensioned, the displacement of the pump 31 can be reduced so as to reduce the flow rate which actuates the motor 23 of the winch 8, but always keeping a minimum flow and pressure to maintain the flexible pulling element 9 in tension. In this way, it is possible to reduce the energy used for the system, i.e. energy is generated only when needed to keep the flexible pulling element 9 tensioned.

Figure 10:
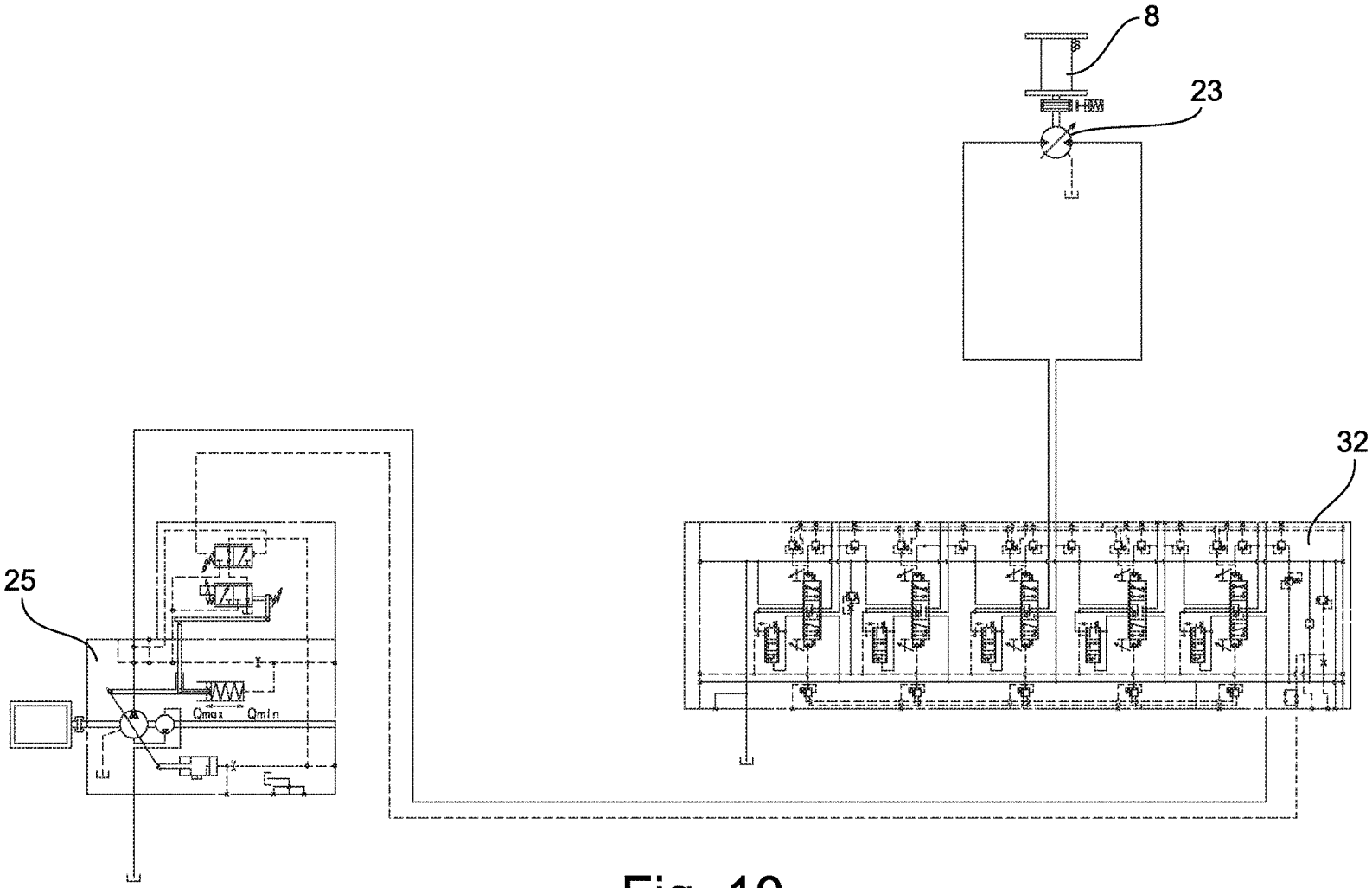
FIG. 10 is a schematic partial view of a control system of a drilling machine according to a fifth embodiment of the present invention.

With reference to FIG. 10, in a variant thereof the system may also be implemented using electrical and/or electro-proportional components, in particular an electrical or electro-proportional distributor 32, i.e. a distributor drivable by electrical signals. In this case, the operating logic of the drilling machine 1 does not change with respect to what has been described previously. Instead of using hydraulic piloting signals to operate the various components that make up the system, electrical signals are used. The flow rate variations generated by the electrical or electro-proportional distributor 32 are in this case controlled by a current variation in the electrical control signals. The power line which drives the winch 8 is still hydraulic but the control signals are electrical and not hydraulic. The manual control element 16 in this case is of the electric type and therefore does not appear among the elements of the hydraulic diagram of FIG. 10.

The solution allows reducing the number of system components, in particular, the first valve assembly 27, 28 and the second valve assembly 19, 22, 24 can be eliminated.

Figure 11:
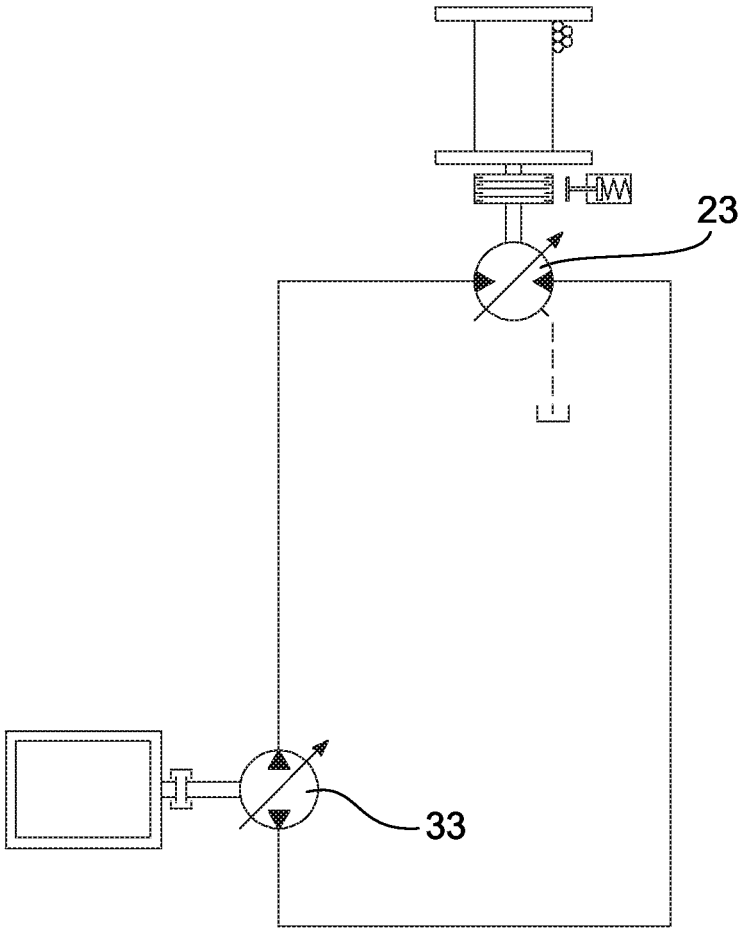
FIG. 11 is a schematic partial view of a control system of a drilling machine according to a sixth embodiment of the present invention.

With reference to FIG. 11, in a variant thereof the system may also be implemented using a closed circuit hydrostatic transmission. In this case, the control system comprises a closed-circuit pump 33 for moving the winch 8. The power that actuates the winch 8 by means of a closed circuit is supplied only by the closed-circuit pump 33 and by the motor 23. Such a closed-circuit pump 33 is in particular of the variable displacement type and is electrically drivable.

The block of the descent movement of the winch through the intervention of the detection device 18 of the loosening of the flexible pulling element 9 is carried out by reducing to zero the displacement of the closed-circuit pump 33. When the control device 43 is activated, it sends an electrical control signal to the regulator of the closed-circuit pump 33 so as to reduce the displacement to zero. In this way, it is possible to block the flow generation of the pump 33 and consequently stop the winch 8.

The slowdown of winch 8 during the descent of the tool is carried out by reducing the displacement of the closed-circuit pump 33 so as to send a lower flow rate to the winch motor. When the second manual selector 17 selects the slower descent mode, it generates an electrical control signal to the regulator of the closed-circuit pump 33 so as to reduce the displacement to a predetermined value to slow down the speed.

When the operator activates the second operating mode by means of the first manual selector 26, the reduced pull winding is carried out by increasing the displacement of the closed-circuit pump 33 to generate a flow rate sufficient to quickly actuate the winch 8 and generate an adequate pressure to recover the loosening of the flexible pulling element 9.

Figure 12:
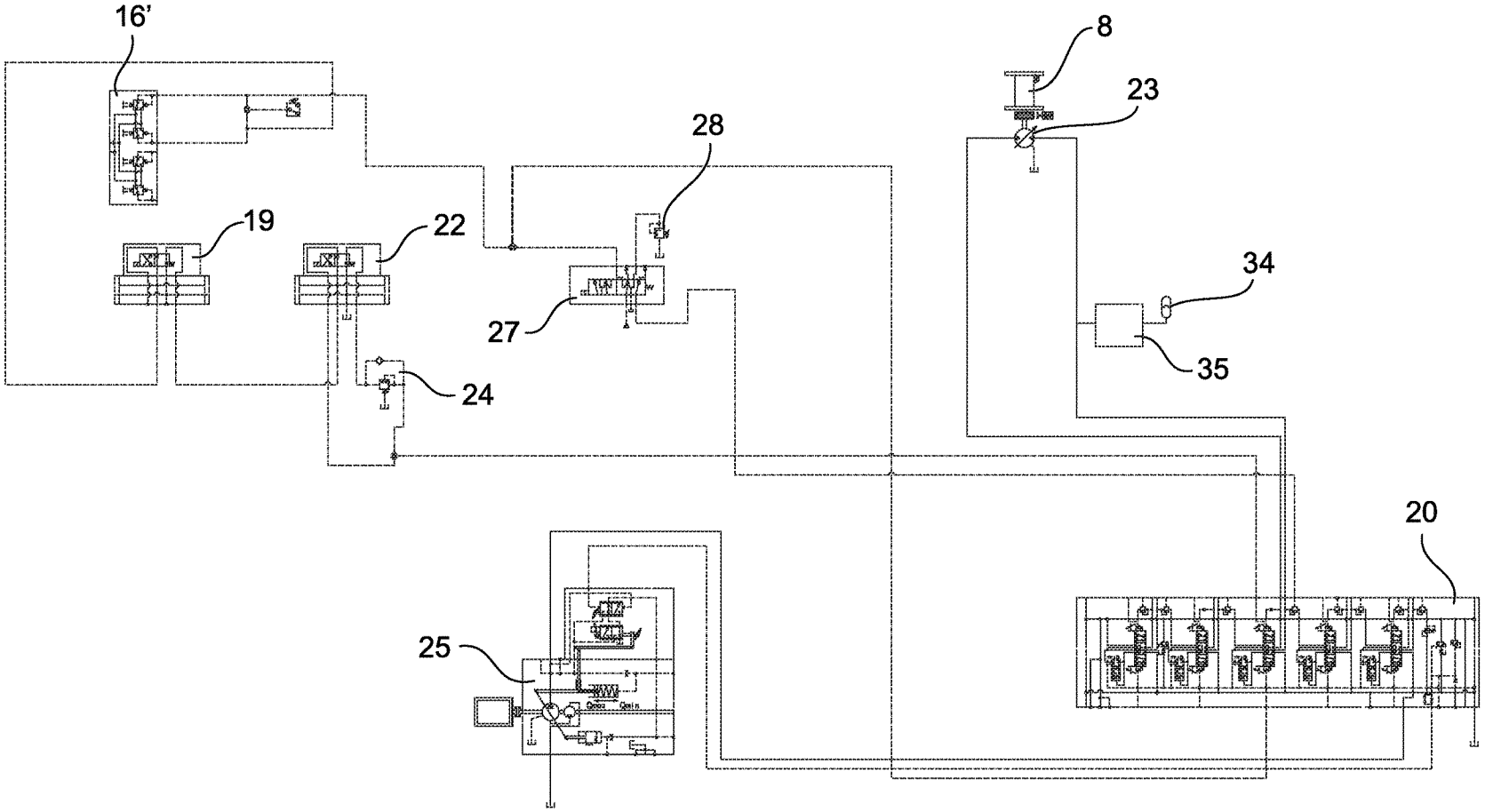
FIG. 12 is a schematic partial view of a control system of a drilling machine according to a seventh embodiment of the present invention.

With reference to FIG. 12, in a variant thereof the system may also be implemented by adding a pressure accumulator 34 connected to a hydraulic supply line of the motor 23 of the winch 8 through the interposition of a control valve 35. In this case, the pressure accumulator 34 is used for storing hydraulic energy during the slowdown phase of the winch 8 when the slow descent mode is selected. The stored energy can be used immediately after stopping the descent of the tool to perform the reduced pull winding provided by the second operating mode. The management of the power storage stages in the accumulator or energy release from the pressure accumulator 34 is managed by the control valve 35. This variant allows creating a completely non-dissipative system since by accumulating the energy in braking, this energy can be reused for the tensioning the flexible pulling element 9, thus reducing the work or energy required to pump 25.

In the present discussion, for simplicity, a drilling machine with a guide tower is described, however, the drilling machine according to the present invention may also be of the crane type equipped with an inclined carrier trellis boom.

The features of the drilling machine object of the present invention as well as the relevant advantages are clear from the above description.

Finally, it is clear that several changes and variations may be made to the drilling machine thus conceived, all falling within the invention; moreover, all details can be replaced with technically equivalent elements. In the practice, the materials used as well as the sizes, can be whatever, according to the technical requirements.

The invention claimed is:

1. A drilling machine comprising:

a string of telescopic rods provided with an excavation tool;

a winch comprising a drum associated with a motor arranged to actuate in rotation said drum;

a flexible pulling element connected, on the one hand, to said drum and on the other hand, to said string of telescopic rods, said flexible pulling element being able to be unwound or wound on said drum in order to move said string of telescopic rods;

a manual control element of said winch that can assume at least a first position, a second position and a third position; and a control system of said motor associated with said manual control element, said control system being configured for controlling said motor, in a first operating mode, so as to unwind said flexible pulling element from said drum in order to lower said string of telescopic rods when said manual control element is in said first position, to wind said flexible pulling element on said drum in order to raise said string of telescopic rods when said manual control element is in said second position, to stop said drum when said manual control element is in said third position;

said drilling machine further comprising a first manual selector associated with said control system and adapted to select at least a second operating mode, and in that said control system is configured for controlling said motor, in said second operating mode, so as to wind said flexible pulling element on said drum in order to tension said flexible pulling element without raising said string of telescopic rods when said manual control element assumes said third position.

2. The drilling machine according to claim 1 comprising a detection device associated with said control system and configured for detecting a loosing of said flexible pulling element, said control system being configured for stopping said drum when said detection device detects the loosing of said flexible pulling element.

3. The drilling machine according to claim 2 wherein said machine comprises a guide tower and said detection device comprises:

a roller mounted on an arm leverage associated with said guide tower in a rotating manner;

a return element constrained, on the one hand, with a portion of said guide tower and on the other hand, with said arm leverage, said return element being arranged to act on said arm leverage so that said roller is pressed against said flexible pulling element; and a control device associated with said arm leverage and arranged to activate and to pilot said control system so as to stop said drum when the angular position of said arm leverage with respect to said guide tower assumes a predefined value that corresponds to a loosing of said flexible pulling element.

4. The drilling machine according to claim 2 comprising:

one or more sensors arranged to detect the depth and the rising or descent speed of said excavation tool;

a processing and control electronic unit connected to said one or more sensors, configured for storing the maximum depth reached by said excavation tool at the end of each excavation phase, and for outputting an alert signal for an operator when at least one of the following events occurs:

during the descent, said excavation tool reaches a depth at a predetermined distance from said maximum stored depth reached by the excavation tool said excavation tool descends at a descent speed higher than a preset threshold value.

5. The drilling machine according to claim 4 further comprising a display connected to said electronic processing unit, said alert signal being displayed on said display.

6. The drilling machine according to claim 2 wherein said control system comprises:

a pump;

an electrically pilotable distributor hydraulically connected to said pump so as to be fed by the same, and electrically connected to said manual control element and to said detection device, said distributor being arranged to hydraulically pilot said motor based on the commands of said manual control element and on the detection of said detection device.

7. The drilling machine according to claim 1 further comprising a second manual selector arranged to select a slowed down descent mode of said excavation tool, said control system being configured for controlling said motor in order to lower said excavation tool at a predefined speed when said slowed down descent mode is selected.

8. The drilling machine according to claim 1 wherein said control system comprises:

a pump;

a distributor connected to said pump so as to be fed by the same, said distributor being arranged to hydraulically control said motor based on the hydraulic piloting signals;

a hydraulic control unit associated with said manual control element and hydraulically connected to said distributor, said hydraulic control unit being capable of sending hydraulic piloting signals to said distributor; and a first valve assembly hydraulically connected to said hydraulic control unit and to said distributor and electrically connected to said first manual selector, said first valve assembly being capable of hydraulically piloting said distributor when the second operating mode is active and said manual control element is in said third position.

9. The drilling machine according to claim 8 wherein said control system further comprises a second valve assembly connected to said distributor, to said hydraulic control unit and to said detection device, said second valve assembly being arranged to control said distributor so as to allow or stop the piloting action of said hydraulic control unit, said second valve assembly being also arranged to adjust the piloting signal of said hydraulic control unit so as to hydraulically pilot said distributor in order to actuate said motor in said slowed down descent mode.

10. The drilling machine according to claim 8 wherein said distributor is of the proportional type.

11. The drilling machine according to claim 8 wherein said distributor is of the non-proportional type and said pump is a fixed displacement pump.

12. The drilling machine according to claim 8 wherein said distributor is of the non-proportional type and said pump is a variable displacement pump.

13. The drilling machine according to claim 9 wherein said control system further comprises a pressure accumulator connected to a hydraulic feeding line of said motor by the interposition of a control valve, said control valve operating so as to store, within said pressure accumulator, hydraulic energy during the descent phase of said excavation tool in said slowed down descent mode, and to use, after the stop of the descent of said excavation tool, said stored hydraulic energy in order to tension said flexible pulling element in said second operating mode.

14. The drilling machine according to claim 1 wherein said control system comprises:

an electrically pilotable variable displacement closed circuit pump arranged to pilot said motor based on the received commands.

* * * * *